US007097795B2

(12) United States Patent
Gotou

(10) Patent No.: US 7,097,795 B2
(45) Date of Patent: Aug. 29, 2006

(54) RECYCLED LUMBER PRODUCING METHOD

(76) Inventor: Shinji Gotou, 8-2-406, Makiochi 5-Chome, Minoo-shi 562-0004 (JP)

( * ) Notice: Subject to any disclaimer, the term of this patent is extended or adjusted under 35 U.S.C. 154(b) by 51 days.

(21) Appl. No.: 10/492,460

(22) PCT Filed: Jul. 31, 2002

(86) PCT No.: PCT/JP02/07819

§ 371 (c)(1),
(2), (4) Date: Apr. 13, 2004

(87) PCT Pub. No.: WO03/037583

PCT Pub. Date: May 8, 2003

(65) Prior Publication Data

US 2004/0183222 A1 Sep. 23, 2004

(30) Foreign Application Priority Data

Oct. 29, 2001 (JP) ..... 2001-331408

(51) Int. Cl.
*B27N 3/08* (2006.01)

(52) U.S. Cl. ..... 264/109; 264/108; 264/914

(58) Field of Classification Search ..... 264/109–128, 264/914

See application file for complete search history.

(56) References Cited

U.S. PATENT DOCUMENTS 5,017,319 A * 5/1991 Shen ..... 264/124
6,344,165 B1 * 2/2002 Coleman ..... 264/517
6,461,553 B1 * 10/2002 Hansen et al. ..... 264/122

* cited by examiner

*Primary Examiner*—Mary Lynn Theisen
(74) *Attorney, Agent, or Firm*—Thompson Hine LLP

(57) ABSTRACT

Waste wood is recycled into a large cross-section wood board without using a hazardous material as a binder. The invention provides a method for manufacturing a recycled wood product, and includes the steps of atomizing, to a wood material containing small wood chips, a mist of high-polymer agent having a natural component as the chief ingredient thereof, pressuring the wood material sprayed with the high polymer mist with the wood material aligned in the length direction thereof, and steam heating the wood material under a high-pressure environment to bond the adjacent wood chips together. A high-polymer agent containing tannin as a chief ingredient is used in one example. A high-polymer agent may be applied on the wood material. The method preferably further includes a curing step for cooling the wood material continuously in the high pressure environment to room temperatures using one of air cooling and natural cooling subsequent to the steam heating step for steam heating the wood material under the high-pressure environment to bond the adjacent wood chips together.

14 Claims, 4 Drawing Sheets

RECYCLED LUMBER PRODUCING METHOD

FIELD OF THE INVENTION

The present invention relates to a technique of processing and manufacturing conventionally unused scrap wood and thinned wood to a wood material product having a large cross section and, in particular, to a technique of manufacturing the wood material product without using a binder hazardous to a physical environment.

DESCRIPTION OF THE RELATED ART

Wood materials are a natural material widely used for buildings and interior in a building. As the wood material finds widespread applications, the natural wood material becomes more and more scarce. Furthermore, unrestrained logging and designless forestation not only reduce the amount of wood material but also adversely affect a natural environment. On the other hand, a great deal of waste wood is caused. The waste wood, if not efficiently used again, is simply burned or buried. The resources are thus simply wasted. The importance of the use of thinned wood is recognized, but recycled wood products are limited in application, quality, and available amount thereof.

A technique overcoming this drawback is known in U.S. Pat. No. 4,061,819, wherein wood fibers are formed in strands, and the strands are bonded together to form a large-cross section board or a plywood board. In this technique, a resin is used as a binder. However, since some types of resin emit a toxic gas in case of fire, the use of a great deal of resin in a construction material is not preferred. Some types of resins are also known to cause the sick house syndrome, and the use of hazardous resins must be avoided.

With a view to the drawbacks of the conventional art, the inventors of this invention have developed a technique that allows waste wood to be recycled into a large cross-section wood board without using a hazardous material as a binder of wood.

SUMMARY OF THE INVENTION

To achieve the object, the present invention provides a method for manufacturing a recycled wood product, and includes the steps of atomizing to a wood material containing small wood chips a mist of high-polymer agent having a natural component as the chief ingredient thereof, pressuring the wood material sprayed with the high polymer mist with the wood material aligned in the length direction thereof, and steam heating the wood material under a high-pressure environment to bond the adjacent wood chips together. The mist of the high-polymer agent serves the function of a binder when a certain condition is satisfied with the small wood chips impregnated with the high-polymer agent. In the step for atomizing the high polymer mist to the wood material, the small wood chips are evenly coated with the high-polymer agent. The high-pressure environment is intended to bond the adjacent wood materials together more tightly. In the steam heating step, wood fibers are softened and swollen. The high-polymer agent is thus activated, providing a high bonding strength. The high-polymer agent may be one of lignin, cellulose, hemicellulose, tannin, etc. The high-polymer agent fuses cells in the wood fibers.

When the high-polymer agent containing tannin as a chief ingredient is used, tannin is combined with formaldehyde. Tannin thus prevents formaldehyde to be present alone in a binder, thereby appropriately controlling the emission of hazardous materials from the recycled wood product.

The inside of the wood fibers of the wood material may not be sufficiently heated by the steam heating only, and is not impregnated with the high-polymer agent. In the step for pre-heating the wood material prior to the atomizing step of the mist of the high-polymer agent, the wood material is pre-heated to activate the function of the high-polymer agent more.

Instead of the step for atomizing the mist of the high-polymer agent, the high-polymer agent may be applied on the wood material. A small diameter mist cannot be efficiently produced in the atomizing step of the high polymer mist if the viscosity of the high-polymer agent is high. Depending on the type of wood, a high viscosity high-polymer agent is required. In such a case, the high-polymer agent is applied on the wood material. If a high-polymer agent such as a tannin-based component only is unable to provide a sufficient bonding strength as a bonding agent, another bonding agent made of a natural component may be mixed with the high-polymer agent for reinforcement. The tannin-based high-polymer agent is typically deeply colored, the resulting recycled wood product also becomes deep in color. If a light color recycled wood product is desired, a white natural pigment may be mixed. The natural pigment is not limited to a white color, and may be determined depending on a desired color tone of the recycled wood product.

The alignment of the wood material in the length direction thereof is performed using a tool having a case and a press attached to an opening of the case. In this arrangement, the tool has the function for determining the dimensions of the recycled wood product, while having the function for conveying the wood material with the high polymer mist sprayed thereon in the aligned state thereof.

The steam heating step includes primary heating performed in a temperature range from about 80 to 120° C. and secondary heating, performed in succession to the primary heating operation, in a temperature range from 120 to 180° C. In this method, the wood fibers are softened during the primary heating, and are then swollen during the secondary heating. The steam heating step assures that the wood material is reliably bonded. The wood material of the small wood chips is preferably dimensioned beforehand into a desired size by a sawing machine. This step improves dimensional precision of the recycled wood product.

The method of the present invention preferably further includes a curing step for cooling the wood material continuously in the high pressure environment to room temperature using one of air cooling and natural cooling subsequent to the steam heating step for steam heating the wood material under the high-pressure environment to bond the adjacent wood chips together. The tannin-based high-polymer agent in accordance with the present invention has a mildly rising bonding strength. If the wood material is released from a high-pressure environment with latent heat maintained therewithin subsequent to the pressurization bonding of the wood material, the wood material will be dried in the insufficient bonded state thereof. The resulting wood product may have a bonding strength weaker than the wood product appears. The curing step prevents the wood product from being weak bonded, and assures reliable bond by maintaining the wood product in the high-pressure environment.

DESCRIPTION OF THE PREFERRED EMBODIMENTS

Figure 1:
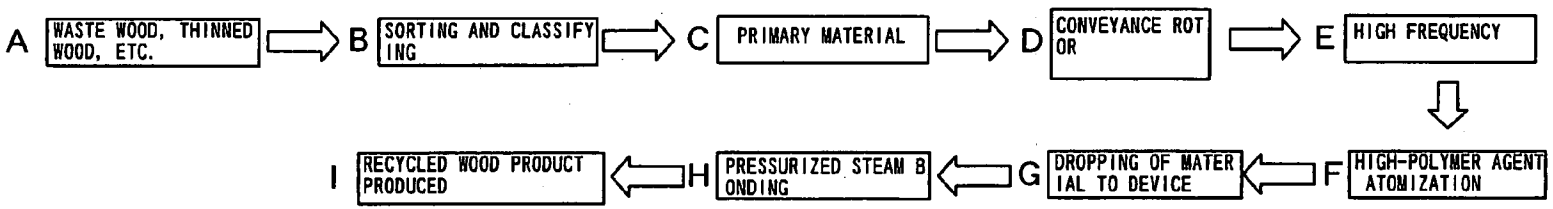
FIG. 1 is a process chart illustrating a series of manufacturing steps of a process of the present invention.

The preferred embodiments of the present invention are discussed with reference to the drawings. FIG. 1 is a first manufacturing method of a wood product in accordance with the present invention. In a process Step A, a wood material is prepared. This step is essential to the production of a recycled wood product, and any wood material such as waste wood and thinned wood may be selected as long as the material is a natural one. A laminated lumber containing a chemical as a binder must be excluded from the wood material because an undesired chemical reaction may occur in the manufacturing process. The laminated wood manufactured in accordance with the present invention, and becoming waste materials after the use thereof, may be used as the wood material again. In a process Step B, collected wood materials are sorted and classified. In this process step, the wood materials are sorted into cedar wood material, Japanese cypress wood material, etc. according to the type of wood. Depending on the application of the wood product, the wood materials may be mixed. In a third process Step C, the wood materials sorted and classified are sawn by a sawing machine into a primary wood material. The wood materials are preferably regulated in size to some degree taking into consideration a subsequent process step for laminating the primary wood material. If the construction waste material is used in this step, unnailing, metal removing, bonding agent and paint removing are performed. The waste material is further cleaned and planarized, as necessary. If the material is thinned wood from a wood thinning operation, a debarking operation and a planarizing operation, if necessary, are performed. It is not necessary to strictly regulate the wood materials in volume and length thereof, and a mix of short and long wood chips is acceptable in lamination. The form of the primary wood materials written as "chips" in this invention is not limited to any particular configuration. The chips as primary wood materials may be strands, right chips, elongated bars, or plywood. The bark of the thinned wood removed in the process may contain significant amount of tannin. As will be discussed later, tannin may be extracted to be used as a bonding agent.

The material is then conveyed to a high-frequency heating bath by a conveyer in a process Step D. The material is irradiated with a high-frequency wave for pre-heating (process Step E). A high-polymer agent functioning as a binder is atomized to the pre-heated material (process Step F). The high-polymer agent is sprayed in a mist because the high-polymer agent preferably uniformly settles on the surface of the material. To laminate the wood in alignment, the material is introduced into an apparatus (process Step G). The material is then heated and pressurized under a steam environment (process Step H). In this way, the high-polymer agent acts under a humid and heated environment, thereby binding the fiber cells of the adjacent materials. Under high pressure, the cell fusion of the wood materials strongly binds the wood fibers. The tool determines the external shape and the dimensions of the laminated wood. Since the wood material is under pressure inside the apparatus, a finished laminated wood product has the size determined by the apparatus. The high-frequency heating bath is intended to uniformly heat the primary wood material to the internal tissue thereof. If the primary wood material is a relatively thin strand or thin plywood, this process may be omitted.

The pre-heating process with the high-frequency wave irradiation in the process Step E is an optional process step and may be omitted. Depending on the nature, size, and thickness of the wood material, internal moisture of the wood may boil quickly and explode in the pre-heating process step. In such a case, the pre-heating process must be omitted.

The finished laminated wood is sawn to a product having a desired dimension (process Step I). In the process Step F, the high-polymer agent is sprayed in a mist, and the process Step E and the process Step F function as a pre-heating step for the process Step H.

The high-polymer agent used in this invention is not a conventional chemical but an agent that is extracted from a natural product. For example, tannin-based high polymer molecules are used as the agent. The high-polymer agent may be moistened. Moistening is intended to supplement moisture to develop steam in a subsequent steam heating and pressurizing process Step H. The moistening is also intended to adjust the density of a tannin-based high polymer molecule emulsion agent appropriate for mist atomization. The tannin-based high polymer molecule has a structure as disclosed in "pages 1–8 of Wood Art No. 61 published in April 1985 in Japanese". This polymer, easily reacting with formaldehyde, substantially controls the separation of formaldehyde from the finished recycled wood product.

As for conditions in the steam heating and pressurizing process Step H, a temperature range in the primary heating is about 80–120° C. Wood softening temperature falls within this temperature range. The wood material is sufficiently impregnated with the high-polymer agent in the softened state thereof, and the adjacent wood fibers strongly bond together. In the secondary heating, the wood material rises to a wood swelling temperature to within a range from 120–180° C. under a pressure of 5–10 ton. In this way, a high polymer bonding reaction occurs with tannin as a base, causing chained wood fibers.

Figure 2:
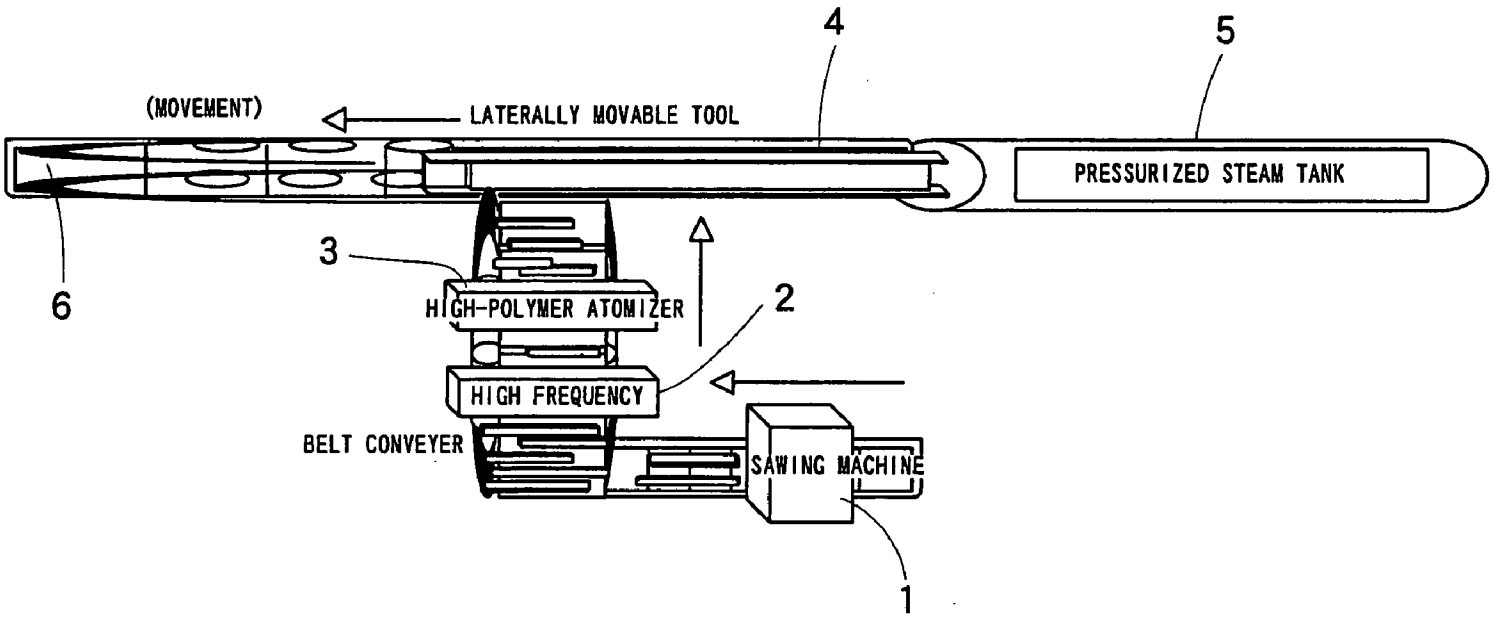
FIG. 2 diagrammatically illustrates an apparatus used in a method for manufacturing a wood product in accordance with the present invention.

FIG. 2 illustrates an apparatus implementing the present invention. As shown, a sawing machine 1 saws the raw material and corresponds to the process Step C shown in FIG. 1. The high-frequency heating bath 2 corresponds to the process Step E shown in FIG. 1. An atomizer 3 atomizes the high-polymer agent and corresponds to the process Step F. Designated 4 is the tool. The tool 4 is laterally slidably supported as shown. Connected to one end of the tool 4 is a high-pressure steam tank 5 for providing steam under a high-pressure environment. The tool 4 has, on the other end thereof, an outlet port 6 through which the wood product is output.

FIGS. 3*a* and 3*b* illustrate preferable embodiment of the tool 4. Referring to FIG. 3*a*, the primary wood material is dropped into a case 4*a* of the tool 4. After the primary wood material is aligned in the length direction thereof, a vibrator vibrates the primary wood material laterally to the right, to the left, and vertically up and down so that the direction of the primary wood material is regulated not to leave large void therewithin. Using a hydraulic press 4*b* shown in FIG. 3*b*, a predetermined pressure is applied to the wood material.

The wood material under this condition is introduced into a high-pressure steam tank 5 to bond the wood fibers together.

In this embodiment, the wood material is introduced into the high-pressure steam tank 5 by moving the tool 4. Conversely, the high-pressure steam tank 5 is moved while the tool 4 remains stationary. It is important that the primary wood material is aligned and then pressurized in the tool 4, and that steam is provided under the high-pressure environment. Which element to move is not important in this invention.

Figure 4:
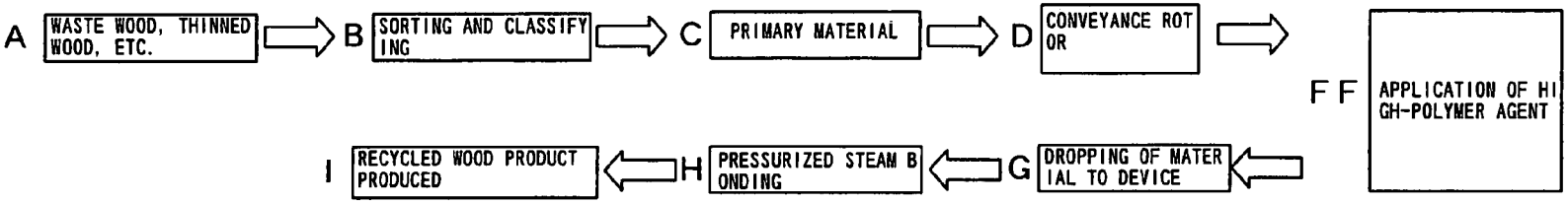
FIG. 4 is a process chart illustrating a series of manufacturing steps of a second process of the present invention.

Referring to FIG. 4, a second example implementing the present invention is discussed. Like in the first example, the high-frequency irradiation Step E, from among the process steps in the first example, may be omitted. In the second example, a high polymer application process Step FF for directly applying the high-polymer agent to the material using a roller or a rotor is used instead of the atomization process Step F for atomizing the mist of the high-polymer agent in the first example. The other process steps remain unchanged from those in the first example. To atomize the high-polymer agent into a mist in the first example, an emulsion having a low viscosity must be used, but in this case, it is difficult to heighten a bonding strength to a high level. If the bonding strength is too weak with the tannin-based bonding agent only, the application process Step FF in the second example may be used. To reinforce the bonding strength, a natural bonding element such as casein is mixed with tannin. Casein, which is an animal protein, may cause fungi, but the development of fungi and decomposition are controlled by tannin because of the sterilization and aseptization effects thereof. Tannin has a deep color, and the color tone of the recycled wood product is also influenced by the color of tannin. To achieve a light color tone on the resulting wood product, a natural pigment may further be mixed with the bonding agent. If a white pigment is used, the wood product has a white color tone. If another color is desired, the pigment is not limited to the white color. Since the pigment is not water soluble, the recycled wood product, if coated with the pigment, becomes water resistant.

Figure 3:
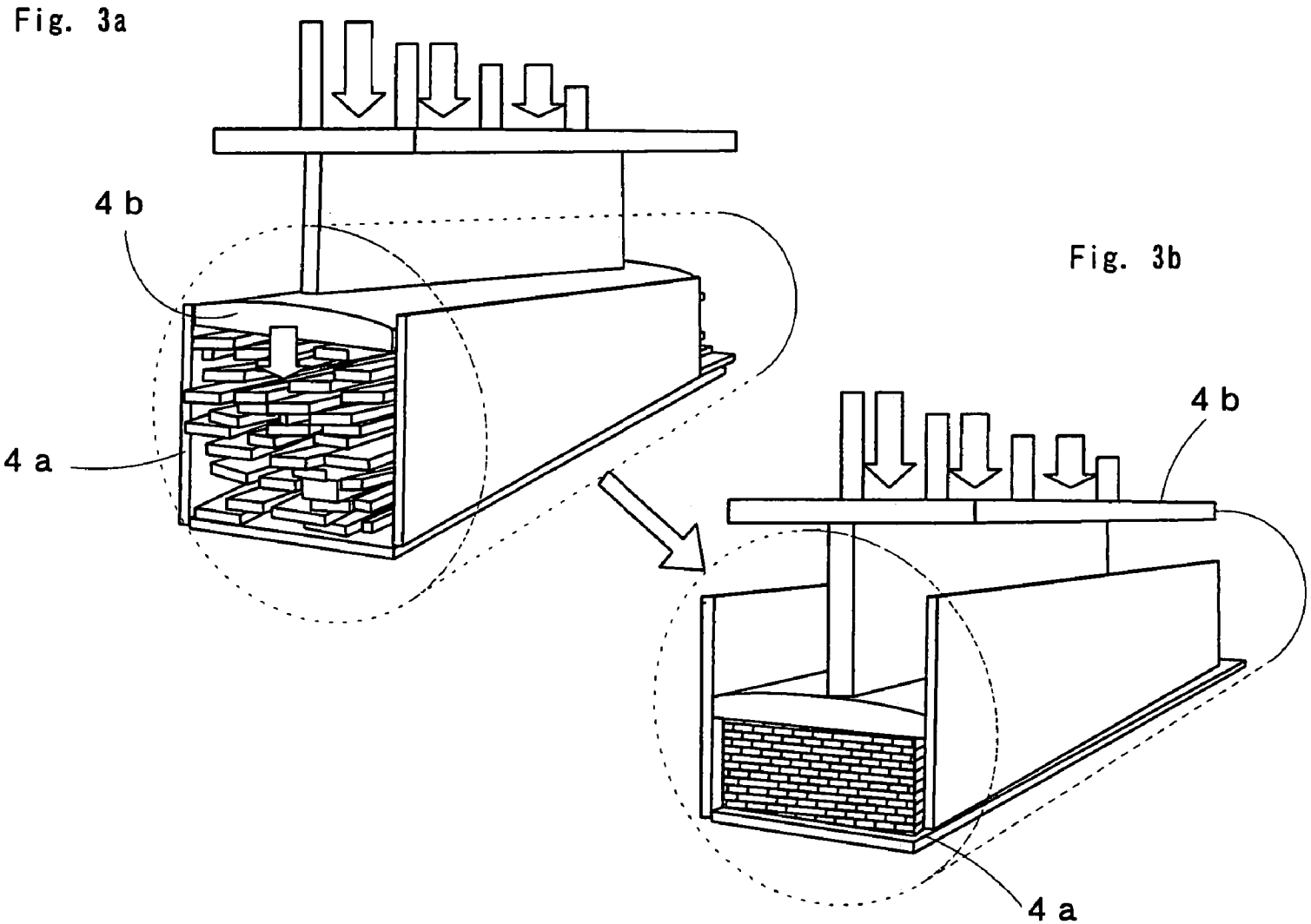
FIG. 3 is a perspective view of a tool used in accordance with the present invention.

In the examples illustrated in FIG. 1 and FIG. 4, the bonding process Step H with steam pressurization completes the recycled wood product. If the recycled wood product steam pressurized using the apparatus shown in FIG. 3 is immediately exposed to the ambient temperature environment, a sharp heat drop rate may distort the wood product. The bonding agent containing a tannin-based high polymer as the chief ingredient thereof mildly develops a bonding strength. If the wood product is released from the held state thereof prior to the development of strong bonding strength, reliable bond may not be attained. This embodiment includes a curing step in which the wood product continuously held in the high pressure environment is cooled to room temperatures using air cooling or natural cooling subsequent to the bonding process Step H. This process step is not essential and may be omitted depending on the size of the recycled wood product. The curing process step for cooling the wood product must avoid using water cooling. If the water cooling is used, the high-polymer agent, which has yet to perform the function thereof, flows out. The curing process step must use one of air cooling and natural cooling.

The present invention provides a method including the steps of atomizing to the wood material containing small wood chips the mist of high-polymer agent having the natural component as the chief ingredient thereof, pressuring the wood material sprayed with the high polymer mist with the wood material aligned in the length direction thereof, and steam heating the wood material under a high-pressure environment to bond the adjacent wood chips together. The natural wood, which has been conventionally disposed as a waste, is efficiently recycled. Since the wood raw materials are bonded together by the high-polymer agent containing the natural component as the chief ingredient thereof, no hazardous material is contained. The recycled wood product itself is also recycled later, making an excellent recycled product.

When a high-polymer agent containing tannin as the chief ingredient thereof is used, tannin reacts with formaldehyde. The finished recycled wood product is thus free from formaldehyde present in the single substance thereof. Even if the recycled wood product is used, no or little separation of formaldehyde occurs. With the recycled wood product used as an interior construction material, the effect of the sick house syndrome is efficiently controlled.

Since the wood material is pre-heated prior to the atomization of the high polymer mist, the inner of the wood material is impregnated with the high-polymer agent. A strong bond thus results. The dedicated tool for aligning the wood material allows the wood material to be pressurized and molded.

Since the steam heating step includes the primary heating performed in the temperature range from about 80 to 120° C. and the secondary heating, performed in succession to the primary heating, in the temperature range from 120 to 180° C., the wood fibers are softened during the primary heating, and are then swollen during the secondary heating. This arrangement allows the high-polymer agent to show full performance and enhances the advantage of the present invention.

The invention of using the high-polymer agent application step instead of the atomization process step for atomizing the mist of the high-polymer agent is applied to a high-polymer agent having a high viscosity. If stronger bonding strength is expected in the high-polymer agent in the application process step, a bonding agent containing a natural component may further be mixed. To change the color tone of the recycled wood product, a natural pigment may be mixed. If a natural pigment is mixed, recycled wood products with a diversity of color tones are provided.

The invention claimed is:

1. A method for manufacturing a recycled wood product, comprising the steps of atomizing to a wood material containing small wood chips a mist of a high-polymer agent having a natural component as the chief ingredient thereof, aligning the wood material in a length direction thereof, pressuring the wood material sprayed with the high polymer mist with the wood material aligned in the length direction thereof, and steam heating the wood material under a high-pressure environment to bond the adjacent wood chips together to form a recycled wood product.

2. A method for manufacturing a recycled wood product according to claim 1, wherein the high-polymer agent contains tannin as the chief ingredient thereof.

3. A method for manufacturing a recycled wood product according to claim 2, wherein the wood material is pre-heated prior to the atomizing of the mist of the high-polymer agent to the wood material.

4. A method for manufacturing a recycled wood product, comprising the steps of applying on a wood material containing small wood chips a high-polymer agent having a natural component as the chief ingredient thereof, pressuring the wood material applied with the high-polymer agent with the wood material aligned in the length direction thereof, and steam heating the wood material under a high-pressure environment to bond the adjacent wood chips together.

5. A method for manufacturing a recycled wood product according to claim 4, wherein the high-polymer agent contains tannin as the chief ingredient thereof.

6. A method for manufacturing a recycled wood product according to claim 5, wherein the high-polymer agent further contains a bonding material containing a natural component.

7. A method for manufacturing a recycled wood product according to claim 6, wherein the high-polymer agent further contains a natural pigment.

8. A method for manufacturing a recycled wood product according to claim 1, wherein the alignment of the wood material in a length direction thereof is performed using a tool having a case and a press attached to an opening of the case.

9. A method for manufacturing a recycled wood product according to claim 1, wherein the steam heating step comprises primary heating performed in a temperature range from about 80 to 120° C. and secondary heating in a temperature range from 120 to 180° C. performed in succession to the primary heating.

10. A method for manufacturing a recycled wood product according to claim 1, wherein the wood material containing the small wood chips is dimensioned beforehand into a desired size by a sawing machine.

11. A method for manufacturing a recycled wood product according to claim 1, further comprising a curing step for cooling the wood material, held continuously in the high-pressure environment, to room temperatures using one of air cooling and natural cooling subsequent to the steam heating step for steam heating the wood material under the high-pressure environment to bond the adjacent wood chips together.

12. A method for manufacturing a recycled wood product according to claim 4, wherein the alignment of the wood material in a length direction thereof is performed using a tool having a case and a press attached to an opening of the case.

13. A method for manufacturing a recycled wood product according to claim 4, wherein the steam heating step comprises primary heating performed in a temperature range from about 80 to 120° C. and secondary heating in a temperature range from 120 to 180° C. performed in succession to the primary heating.

14. A method for manufacturing a recycled wood product according to claim 4, wherein the wood material containing the small wood chips is dimensioned beforehand into a desired size by a sawing machine.

* * * * *